US005694649A

United States Patent [19]

Hefling et al.

[11] Patent Number: 5,694,649

[45] **Date of Patent: *Dec. 9, 1997**

[54] ADJUSTABLE BASEBALL BATTER'S AND CATCHER'S HELMET WITH MASK

[75] Inventors: Dennis V. Hefling, Ballwin; Matthew Winningham, Bridgeton; Randy D. Black, Webster Groves, all of Mo.

[73] Assignee: Rawlings Sporting Goods Company, Inc., St. Louis, Mo.

[ * ] Notice: The term of this patent shall not extend beyond the expiration date of Pat. No. 5,575,017.

[21] Appl. No.: 740,317

[22] Filed: Oct. 28, 1996

Related U.S. Application Data

[63] Continuation-in-part of Ser. No. 587,602, Jan. 2, 1996, Pat. No. 5,575,017.

[51] Int. Cl.[6] ..... A42B 3/00

[52] U.S. Cl. ..... 2/418; 2/424; 2/425

[58] Field of Search ..... 2/410, 411, 414, 2/417, 418, 420, 421, 425, 416, 9, 424

[56] References Cited

U.S. PATENT DOCUMENTS

| | | | |
|---|---|---|---|
| 2,250,275 | 7/1941 | Riddell | 2/2 |
| 2,706,294 | 4/1955 | Sprinkle . | |
| 2,739,310 | 3/1956 | Frieder et al. . | |
| 2,822,546 | 2/1958 | Barker, Jr. . | |
| 2,969,546 | 1/1961 | Morgan, Jr. . | |
| 2,983,923 | 5/1961 | Aileo . | |
| 3,042,927 | 7/1962 | Mauro et al. . | |
| 3,087,166 | 4/1963 | Howard . | |
| 3,107,356 | 10/1963 | Pestronk et al. . | |
| 3,111,674 | 11/1963 | Marietta . | |
| 3,183,522 | 5/1965 | Groot | 2/6 |
| 3,305,874 | 2/1967 | Peham | 2/183 |
| 3,374,299 | 3/1968 | Peham | 264/45 |
| 3,465,363 | 9/1969 | Raney . | |
| 3,486,169 | 12/1969 | Rawlings . | |
| 3,510,879 | 5/1970 | Webb . | |
| 3,590,388 | 7/1971 | Holt . | |
| 3,600,713 | 8/1971 | Holt . | |
| 3,605,113 | 9/1971 | Marietta . | |
| 3,609,765 | 10/1971 | Molitoris . | |
| 3,729,745 | 5/1973 | Latina | 2/9 |
| 3,732,574 | 5/1973 | Hale | 2/9 |
| 3,950,788 | 4/1976 | Lamb . | |
| 4,287,613 | 9/1981 | Schulz | 2/413 |
| 4,627,114 | 12/1986 | Mitchell | 2/414 |
| 4,901,373 | 2/1990 | Broersma | 2/421 |
| 4,932,076 | 6/1990 | Giorgio et al. . | |
| 5,093,936 | 3/1992 | Copeland et al. | 2/419 |
| 5,152,705 | 10/1992 | Edwards | 2/418 |
| 5,315,718 | 5/1994 | Barson et al. | 2/418 |

OTHER PUBLICATIONS

Page 8 and front and back cover sheets of *Cooper's* 1996 Spring and Summer catalog.

*Primary Examiner*—Michael A. Neas
*Attorney, Agent, or Firm*—Stinson, Mag & Fizzell

[57] ABSTRACT

An adjustable baseball batter's and catcher's helmet automatically adjusts and grips wearer's heads of differing sizes. The helmet has a rigid shell with shock absorbing foam pads secured to the interior of the shell. An elastic band or strap extends horizontally within the helmet and has a mid-portion secured to the back of the helmet. Arms of the elastic strap diverge forwardly and end in attachments under the front portions of the side pads of the helmet. The V-shaped elastic band snugly cradles and forwardly biases the helmet on the wearer's head and tends to space the helmet from the wearer's head at the sides and rear areas. The catcher's helmet is known as a half-hat, and in combination with a catcher's mask, provides the same function as the batter's helmet. The helmet is believed particularly useful in youth baseball leagues which have limited budgets and time to individually fit helmets to players' heads.

5 Claims, 3 Drawing Sheets

ADJUSTABLE BASEBALL BATTER'S AND CATCHER'S HELMET WITH MASK

This is a continuation-in-part application of Ser. No. 08/587,602 entitled "Adjustable Baseball Batter's Helmet" filed Jan. 2, 1996, now U.S. Pat. No. 5,575,017, which is incorporated herein by reference.

FIELD OF THE INVENTION

The present invention relates to helmets for wearing during sports play and more particularly to adjustable helmets.

BACKGROUND OF THE INVENTION

Baseball helmets are commonly used and are required for league play, as a hard thrown baseball pitch or bat deflected ball striking a batter's head may cause injury and even death. While no batter's helmet may totally prevent head injuries, they can reduce the severity of the injury and in many cases prevent injury. Baseball batters' helmets use a shell with a crown portion, a forwardly projecting bill and rigid earflaps extending downwardly and forwardly to protect the sides of the head. Some helmets are fitted with additional face protectors, particularly where the player may be prone to re-injury from being struck on the side of the face with a pitched ball.

Helmets are available in different sizes and may be purchased by the player or assigned by a team to fit a certain player. Other helmets may be adjusted to particular head sizes by the use of removable and replaceable pads within a standard size of helmet shell. While it is common in professional or semi-professional play, or at college or occasionally even at high school level, to have players with assigned helmets, for youth leagues such as Little League, the players seldom have individually sized helmets, and the helmets are often too floppy and tend to fall down over the eyes of the wearer. The helmets also often fall off during base running, leaving the runner vulnerable to head injury if hit by a ball thrown to the baseman.

The present invention is designed to alleviate the above common problems and provides a helmet which automatically adjusts and grips a wearer's head, within a broad size range, such as 6-⅜ to 7-½. There are no pads to remove and replace to adjust size. There is no designated size of the helmet to which the batter must pay attention, and the batter simply picks up a helmet and places it on his head. This is a "one size fits all" helmet, does not flop down over the eyes of the batter and stays on during base running.

A catcher's half-hat helmet of the same design is also provided to adapt to various head sizes of catcher's in youth leagues.

DESCRIPTION OF THE PREFERRED EMBODIMENT

As required by the statutes and case law, a detailed embodiment of the present invention is disclosed herein. It is, however, to be understood that the disclosed embodiment is merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
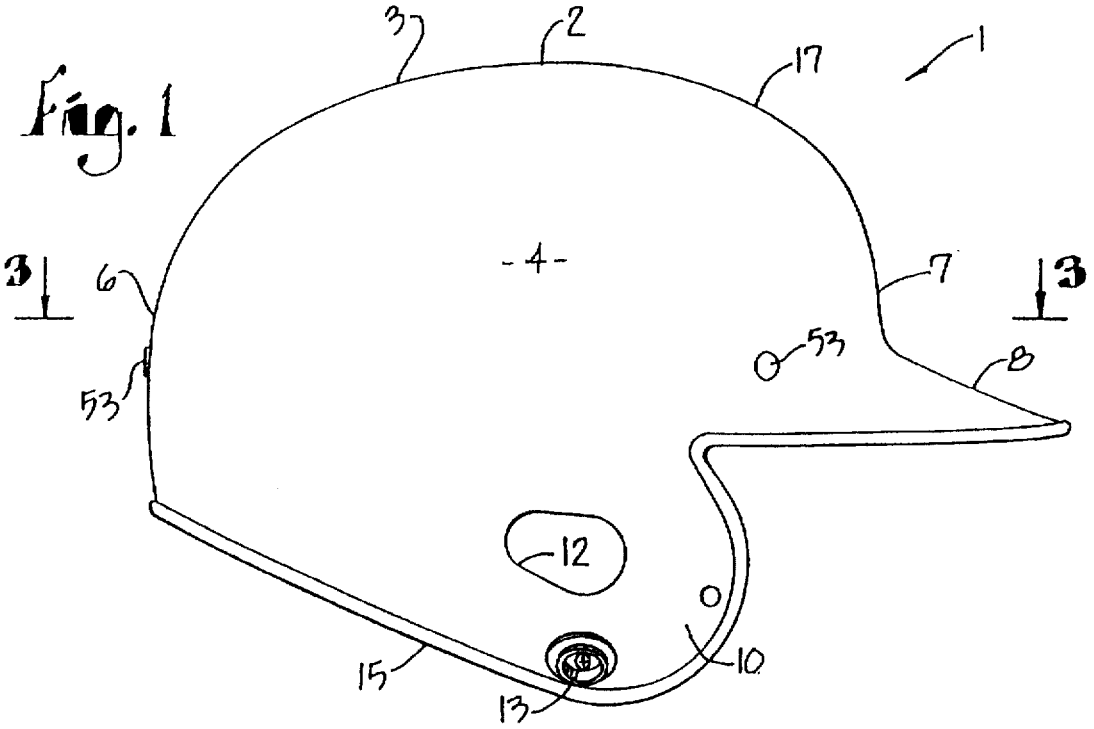
FIG. 1 is a side elevational view of a batter's helmet embodying the present invention.
Figure 2:
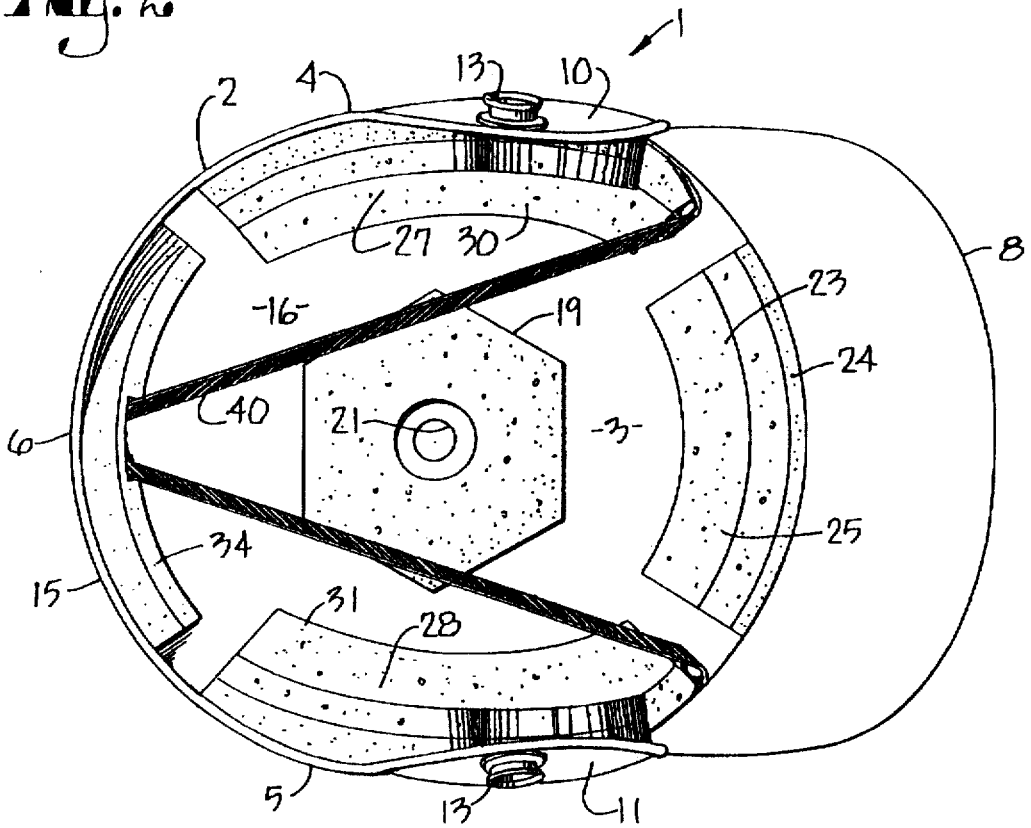
FIG. 2 is a bottom view of the batter's helmet.
Figure 3:
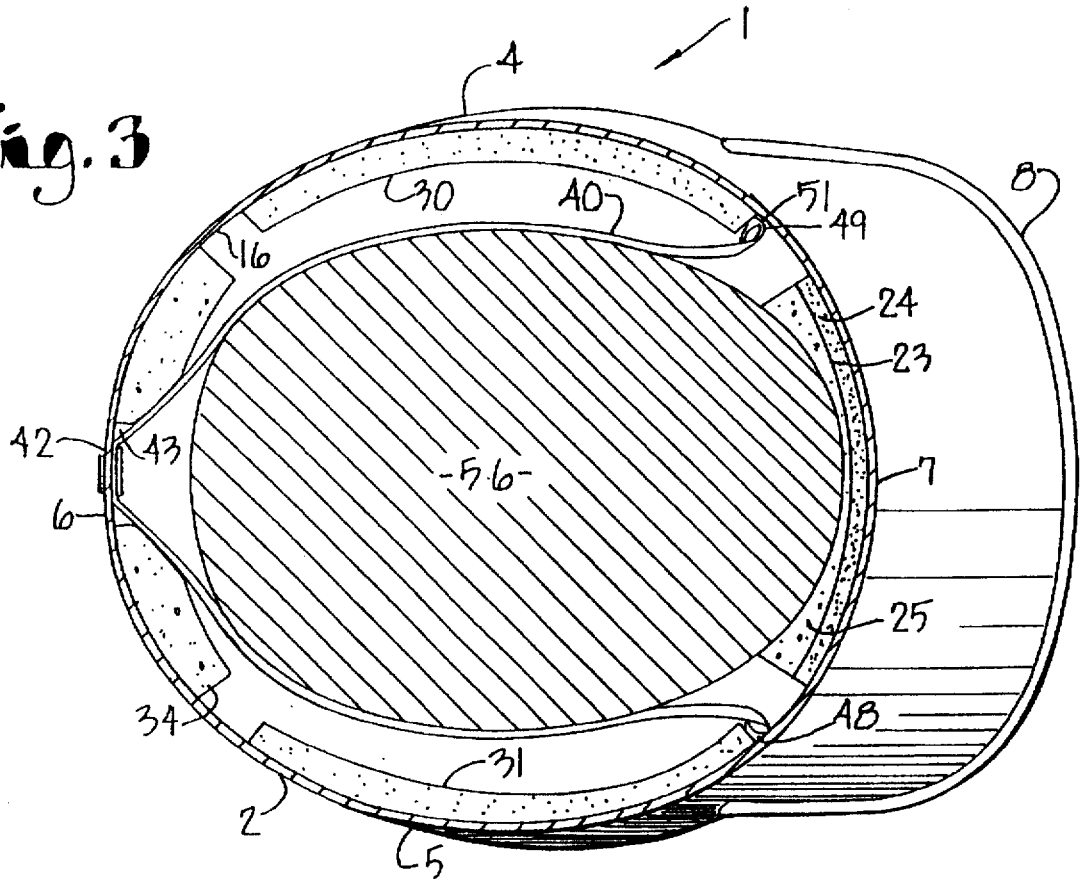
FIG. 3 is a sectional view of the batter's helmet taken along lines 3—3, FIG. 1, and having a representation of a wearer's head in the helmet.

Reference 1, FIGS. 1, 2 and 3, generally designates a baseball batter's helmet made in accordance with the present invention. The helmet 1 includes a shell 2 including a crown 3, opposite sides 4 and 5, back and front portions 6 and 7 and a bill 8. Earflaps 10 and 11 extend downwardly from the respective sides 4 and 5 and have earholes 12 for hearing. Grommets 13 at the bottom of the earflaps 10 and 11 permit connection of a chin strap (not shown). A border 15 extends around exposed edges of the shell 2. The shell 2 includes an interior 16 and an exterior 17. In the above-stated example, the shell 2 is a standard Rawlings Sporting Goods shell and has been made for many years. It is preferably constructed of a rigid plastic material which is sufficiently sturdy to withstand a baseball hit or bat blows. The preferred material of construction is ABS or Polycarbonate.

Preferably, the shell 2 is selected to be sufficiently large so that one size fits all. The padding and elastic straps within the helmet are able to accommodate head sizes from extra small (6-⅜) to extra large (7-½).

The batter's helmet 1 contains pads secured, as by gluing to the interior 16 of the shell 2 and includes a crown pad 19, preferably of hexagonal shape affixed to the apex of the shell crown 3. A top hole 21 extends through the crown pad 19 and the shell crown 3 for air circulation. The crown pad 19 is preferably a dual density pad containing a first layer of a high density and relatively stiff foam with the stiff foam contacting the shell interior 16 and a second or interior layer of a low density, very spongy foam for contact with the wearer. A front pad 23 is of this type, with FIG. 2 illustrating the thinner high density layer 24 and the outer low density spongy layer 25. The low density or spongy layer 25 provides a comfortable fit. Such a dual layer pad is also located at the interior of each ear flap 10 and 11, identified as ear flap pads 27 and 28. Above the ear flap pads 27 and 28 is a thicker, high density foam pad 30 and 31, respectively adjacent the sides 4 and 5. A rear pad 34 is a single layer pad and is of the high density foam. The dual density foam layers provide comfort to the wearer's sensitive forehead and ear areas while providing sufficient protection in the event of impact. The pads are shock absorbing material and are intended to prevent, or at least reduce, the transfer of shock to the head of the wearer. The pads are spaced from each other to provide channels for air circulation. The pads, particularly the ear flap pads 27 and 28, act as adjustment mechanisms to adjust to the size of the wearer's head.

An elastic band or strap 40 may be of various suitable materials and construction. In the illustrated example, the elastic band is of 1-½" wide material with an unextended length of 16". The preferred material of the elastic strap 40 is a 150/2 denier textured polyester on the face back and binder with an elastomer core of 30 gauge rubber. The elastomer cover top is preferably 30/1 spun polyester with an elastomer cover bottom and filling of 150/1 denier textured polyester and 150/2 denier textured polyester respectively. The elastic strap preferably has a manual elongation of 55% plus or minus 10 with a 10% maximum shrinkage. The material content is approximately 90% polyester and 10% rubber. Other types of elastic straps may provide suitable results, and the above description is not intended to be limiting.

Figure 4:
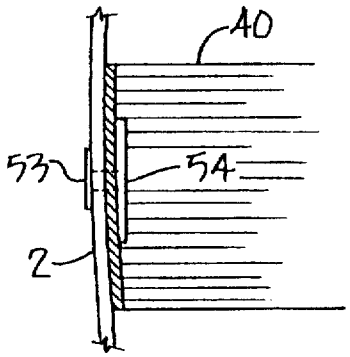
FIG. 4 is a fragmentary view showing details of connection between an elastic strap within the batter's helmet and a manner of attachment to the helmet shell.

The elastic strap is preferably of a continuous length and extends generally horizontally within the shell 2. The elastic strap 40 has a length substantially less than the inner periphery of the shell 2 and has a mid-portion 42, FIG. 3, secured to the shell 2 through a hole 43 in the rear pad 34. Opposite arms 45 and 46 of the elastic strap 40 diverge forwardly from the mid-portion 42 to form a substantially V-shape harness with ends 48 and 49 secured to the interior of the shell 2 at forward edges 51 of the side pads 30 and 31. Details of the strap to shell connection are shown in FIG. 4 wherein a rivet 53 with a large size backing 54 is extended through the material of the elastic strap and the shell 2. There are three rivets 53, one at the back and two at the sides of the shell 2.

An example of the use of the batter's helmet is shown in FIG. 3 wherein the large shape at 56 represents a user's head. The head 56 is shown herein to be a small head, as would be the case of a 7 or 8-year-old player, and as can be quickly appreciated, but for the elastic strap 40 arrangement, the helmet 1 would be much too large for the youth. However, as illustrated herein, the youth with a small head can wear the batter's helmet 1 with the elastic strap 40 snugly cradling and forwardly biasing the helmet 1 on the wearer's head and tending to space the helmet 1 from the wearer's head at the sides 4 and 5 and rear or back portion 6. The elastic strap 40 snugly connects the helmet to the player's head and in combination with the resilient foam pads accommodates wear by players with differing sizes of head size. For example, if a youth with a significantly larger head would wear the batter's helmet 1, the elastic strap 40 would stretch until such time that the head contacted the side pads 30 and 31 and rear pad 34, at which time the elastic strap would lie smoothly against the pads and with the connection rivets 53 displaced from the wearer's head by the thickness of the respective pads. With this arrangement of the elastic strap 40, there are no rivets, clips, or other connections to dig into the wearer's head and make the wear of the helmet uncomfortable. Further, the dual density foam used at the front and ear flap portions of the batter's helmet makes the helmet even more comfortable and adaptable to wear by various sizes of players.

Figure 5:
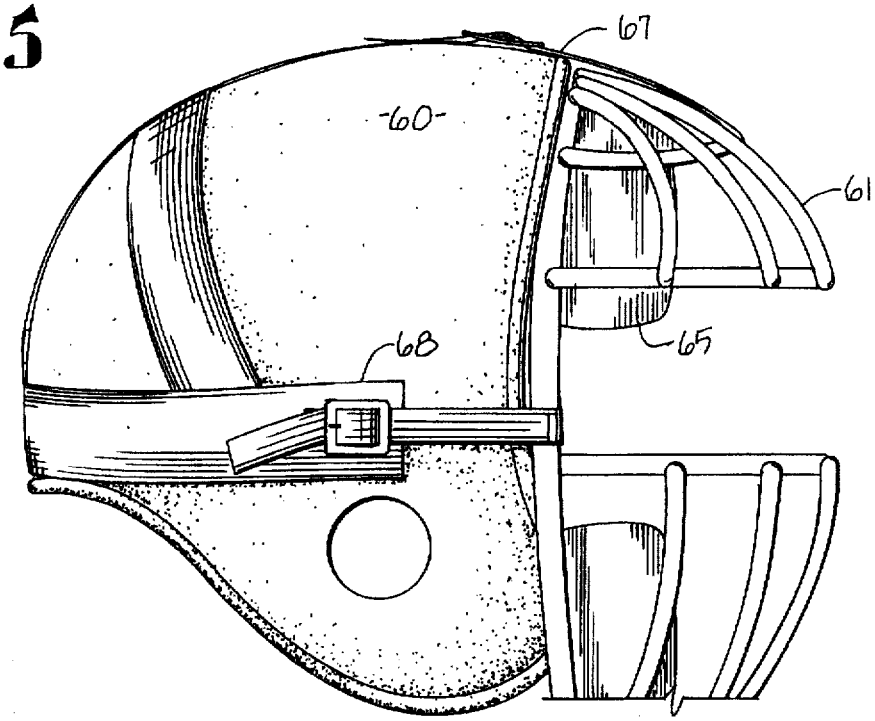
FIG. 5 is a side elevational view of a catcher's half-hat helmet connected to a face mask and embodying the present invention.
Figure 6:
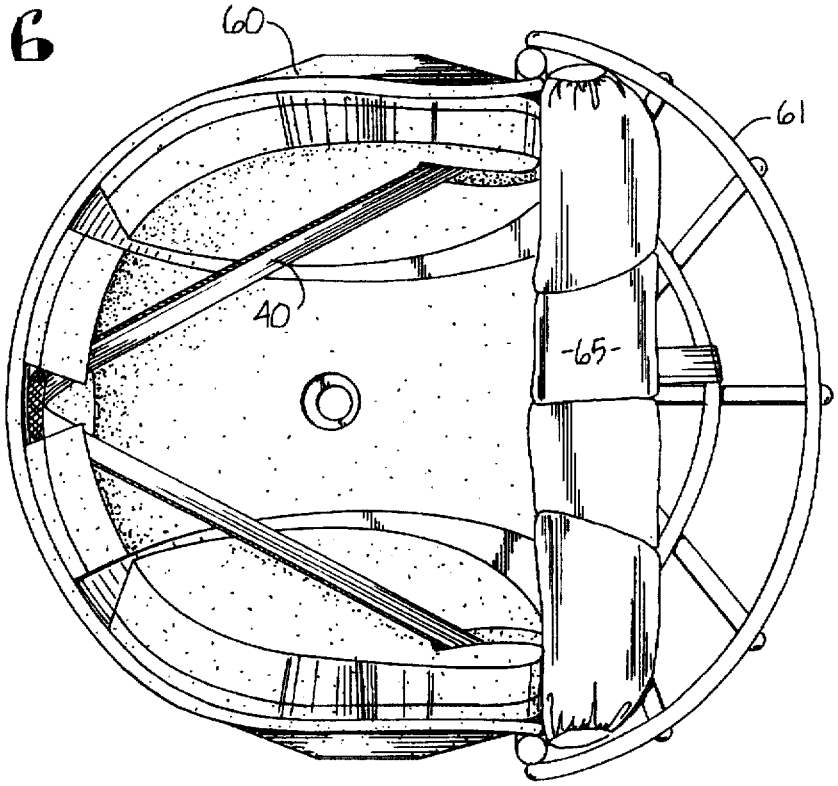
FIG. 6 is a bottom view of the catcher's helmet and mask.

An alternative embodiment of the batter's helmet with v-strap is shown in connection with FIGS. 5 and 6, disclosing a catcher's half-hat helmet 60 combined with a catcher's mask 61. The catcher's half-hat helmet 60 is substantially the same as the batter's helmet 1 and including the same elastic strap 40 in a v-shape harness configuration as disclosed in connection with the batter's helmet 1. The difference is that the catcher's half-hat configuration helmet 60 lacks a front portion of the helmet. The helmet front portion is provided by the catcher's mask 61, which includes the usual padding 65 and is removably mounted to the catcher's half-hat 60 by a top strap 67 and opposite side straps 68. The elastic strap 40 in the v-shape configuration maintains the combined catcher's half-hat helmet 60 and catcher's mask 61 on the wearer's head in the same manner as the batter's helmet 1.

It is to be understood that while certain forms of the invention have been illustrated and described herein, it is not to be limited to the specific forms or arrangement of parts described as shown except as set forth in the following claims.

What is claimed and desired to be secured by Letters Patent is as follows:

1. A protective catcher's half-hat helmet for automatically adjusting and gripping wearers' heads of different sizes, said helmet comprising:

a) a rigid helmet shell defining a cavity and having top, rear and side portions shaped to protect the top, rear and side areas of a wearer's head;

b) shock absorbing material secured to an interior of said shell;

c) a substantially one piece elastic strap having a mid-portion secured substantially directly to the interior of said shell at said rear portion and having opposite arms diverging forwardly to form a substantially V-shaped harness extending substantially into said shell cavity and with ends secured substantially directly to the interior of said shell at front side portions;

d) said helmet being mateable with a face mask forming a front portion to said half-hat helmet; and e) said elastic strap snugly cradling and forwardly biasing said half-hat helmet on the wearer's head, and tending to space said helmet from the wearer's head at said sides and rear areas, said opposite arms being stretched and pulled outwardly from one another to accommodate the wearer's head.

2. A protective catcher's half-hat helmet for automatically adjusting and gripping wearers' heads of different sizes, said helmet comprising:

a) a rigid shell defining a cavity and having top, rear and side portions shaped to protect the top, rear and side areas of a wearer's head;

b) shock absorbing pads secured to the interior of said shell and located at said top, rear and side portions, said pads extending inwardly for contact with a wearer's head;

c) said helmet being mateable with a face mask forming a front portion to said half-hat helmet;

d) an elastic strap extending generally horizontally within said shell and having a length substantially less than the inner periphery of said shell, said elastic strap having a mid-portion secured to said shell at said rear portion and having opposite arms diverging forwardly to form a substantially V-shaped harness extending substantially into said shell cavity and with ends secured to the interior of said shell at front side portions and under said pads at said side portions; and e) said elastic strap snugly cradling and forwardly biasing the helmet on the wearer's head and tending to space the helmet from the wearer's head at said sides and rear portions, said opposite arms being stretched and pulled outwardly from one another to accommodate the wearer's head.

3. The helmet set forth in claim 2 wherein said shock absorbing pads are of foam materials in two different densities, including a soft foam layer for positioning against the wearer's head and a hard foam layer against the interior of said shell.

4. The helmet set forth in claim 2 wherein said elastic strap is secured to said shell by rivets.

5. A baseball catcher's half-hat helmet automatically adjustable to heads of differing sizes, said helmet comprising:

a) a rigid shell defining a cavity and having top, rear and side portions shaped to protect the respective areas of a wearer's head;

b) shock absorbing dual density foam pads secured to the interior of said shell and located at said top, rear and side portions, with a hard foam layer adjacent to the interior of said shell and a soft foam layer adjacent to the wearer's head and compressible to adjust to the size of the wearer's head;

c) said helmet being mateable with a face mask forming a front portion to said half-hat helmet;

d) an elastic strap extending generally horizontally within said shell and having a length substantially less than the inner periphery of said shell, said elastic strap having a mid-portion secured to said shell at said rear portion and having opposite arms diverging forwardly to form a substantially V-shaped harness extending substantially into said shell cavity and with ends secured to the interior of said shell at front side portions and under said pads at said side portions; and e) said elastic strap snugly cradling and forwardly biasing the helmet on the wearer's head and tending to space the helmet from the wearer's head at said sides and rear portions so that adjustment to head size is provided by said dual density foam pads and said elastic strap, said opposite arms being stretched and pulled outwardly from one another to accommodate the wearer's head.

* * * * *